US010096943B2

(12) United States Patent
Archuleta

(10) Patent No.: US 10,096,943 B2
(45) Date of Patent: Oct. 9, 2018

(54) RESTRAINING DEVICE FOR RESTRAINING A COUPLING FROM DISENGAGING

(71) Applicant: Vincent Simon Archuleta, Summerset, SD (US)

(72) Inventor: Vincent Simon Archuleta, Summerset, SD (US)

( * ) Notice: Subject to any disclaimer, the term of this patent is extended or adjusted under 35 U.S.C. 154(b) by 0 days.

(21) Appl. No.: 15/266,957

(22) Filed: Sep. 15, 2016

(65) Prior Publication Data

US 2018/0076569 A1 Mar. 15, 2018

(51) Int. Cl.

| | |
|---|---|
| ***H01R 33/00*** | (2006.01) |
| ***H01R 13/639*** | (2006.01) |
| ***H01R 24/28*** | (2011.01) |
| ***H01R 13/631*** | (2006.01) |
| *H01R 107/00* | (2006.01) |

(52) U.S. Cl.

CPC ..... *H01R 13/639* (2013.01); *H01R 13/631* (2013.01); *H01R 24/28* (2013.01); *H01R 2107/00* (2013.01)

(58) Field of Classification Search

CPC ..... H01R 2201/02; H01R 2201/26; H01R 13/73; H01R 31/06; H01R 13/6271; H01R 13/6275; H01R 13/447; H01R 13/6395; H01R 13/6397

USPC ..... 439/352, 34, 35, 144, 373, 353; 280/422

See application file for complete search history.

(56) References Cited

U.S. PATENT DOCUMENTS

| | | | | |
|---|---|---|---|---|
| 3,915,476 | A * | 10/1975 | Burkle | H01R 13/62 280/422 |
| 4,564,252 | A * | 1/1986 | Kato | H01R 13/6275 439/348 |
| 5,383,794 | A * | 1/1995 | Davis | H01R 13/6275 439/352 |
| 5,593,313 | A * | 1/1997 | Shibuya | H01R 13/6395 439/372 |
| 6,261,116 | B1 * | 7/2001 | Ceru | H01R 13/6272 439/352 |
| 6,273,756 | B1 * | 8/2001 | Ward | H01R 13/6596 439/372 |
| 6,443,753 | B1 * | 9/2002 | Bludis | H01R 13/639 439/373 |
| 6,739,896 | B2 * | 5/2004 | Sivertsen | H01R 13/6395 174/135 |
| 6,767,237 | B1 * | 7/2004 | Shih | H01R 13/6392 439/371 |
| 7,513,791 | B1 * | 4/2009 | Gary | H01R 13/6395 439/373 |
| 7,758,371 | B2 * | 7/2010 | Carmitchel | H01R 13/6392 439/363 |
| 7,850,478 | B2 * | 12/2010 | Lin | H01R 13/6395 439/372 |
| 8,328,574 | B1 * | 12/2012 | Lin | H01R 13/6275 439/321 |

(Continued)

*Primary Examiner* — Hae Moon Hyeon

(74) *Attorney, Agent, or Firm* — Willie Jacques

(57) ABSTRACT

A device for restraining a coupling from disengaging is provided. The coupling includes a plug member and a socket member. The plug member couples with the socket member. The device includes an elastic member. The elastic member has a slot in a first portion. The elastic member detachably connects to the socket member at a first end and operably engages to the plug member at a second end through the slot.

14 Claims, 9 Drawing Sheets

(56) References Cited

U.S. PATENT DOCUMENTS

| | | | | |
|---|---|---|---|---|
| 8,535,071 | B1 * | 9/2013 | Mueller | B60D 1/64 439/144 |
| 8,556,647 | B2 * | 10/2013 | Carmitchel | H01R 13/6395 439/354 |
| 8,888,515 | B2 * | 11/2014 | Hachadorian | H01R 13/5213 439/142 |
| 9,543,719 | B2 * | 1/2017 | Bartholomew | H01R 13/6395 |
| 2013/0095691 | A1 * | 4/2013 | Blanton | H01R 13/6392 439/370 |

* cited by examiner

RESTRAINING DEVICE FOR RESTRAINING A COUPLING FROM DISENGAGING

TECHNICAL FIELD

The present disclosure generally relates to a restraining device, and particularly relates to a device for restraining a coupling from disengaging.

BACKGROUND

Heavy duty vehicles such as, but not limited to, semi trailer trucks generally include a tractor unit having an engine, a cabin and a control system for the vehicle and a trailer unit connected to the tractor unit. The trailer unit may embody electrical units which are electrically coupled with the control system of the vehicle. The electrical unit typically includes a coupling having a plug element and a socket element that are mechanically coupled for providing electric coupling to the trailer unit. The plug element is made to connect with an electrical cable extending from the control system of the vehicle. The socket element of the coupling is generally attached to the trailer unit.

One known way of mechanically coupling the plug element with the socket element is provided using a spring and a ratchet mechanism. In this mechanical coupling, the socket element is provided with a hinged cap tensioned with a spring and a ratchet on the cap. Once the plug element is inserted, the hinged cap tensioned by the spring forces the cap to close and thus the ratchet mechanically couples the plug element with the socket element. Though the spring and the ratchet holds the plug element with the socket element, the coupling between the plug element and the socket element can weaken over time causing disengagement of the plug element from the socket element. Thus, the electrical connection between the trailer unit and the control system of the vehicle is also disconnected.

In view of one or more problems stated above, there is a need for an improved restraining mechanism for continuous engagement of the plug element with the socket element.

SUMMARY OF THE DISCLOSURE

The present disclosure relates to a device for restraining a coupling from disengaging. The coupling includes a socket member and a plug member. The plug member is located on a tractor unit of a vehicle and the socket member is located on a trailer unit of the vehicle. The device of the present disclosure further includes an elastic member. The elastic member is operably engaged with the coupling such that the plug member is restrained from disengaging from the socket member. The elastic member includes a slot at one end. The other end of the elastic member is detachably attached to the socket member. The elastic member is stretched until the slot is placed on a wing unit of the plug member. This connected arrangement, of the elastic, stretchable member, ensures a secure mechanical connection of the plug member to the socket member even when the coupling is subjected to disturbances or vibrations of the tractor and trailer units, respectively.

The present disclosure relates to a device including at least one elastic member. The device restrains a coupling including a plug member and a socket member from disengaging. The plug member is adapted to couple with the socket member. The elastic member includes a slot. The elastic member is detachably connected to the socket member at a first end. The elastic member is operably engaged to the plug member at a second end through the slot.

According to some embodiments, the present disclosure relates to a device including at least one elastic member including a handle, and a connecting member. The elastic member includes a slot. The elastic member is detachably connected to the socket member at a first end of the elastic member and operably engaged to the plug member at a second end of the elastic member through the slot. The handle of the elastic member includes a pair of tabs extending perpendicular to the second end of the elastic member. The pair of tabs is adapted to maneuver the elastic member during assembling. The connecting member is adapted to connect the elastic member with the socket member. The connecting member includes one or more bolts and a bracket member.

The plug member is restrained from disengaging from the socket member by operably engaging the device with the coupling. This arrangement ensures consistent power supply and electrical communication to the trailer unit from the tractor unit of the vehicle via an electrical cable connected in the plug member.

Other features and aspects of this disclosure will be apparent from the following description and the accompanying drawings.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

The detailed description describes non-limiting exemplary embodiments. Any individual features may be combined with other features as required by different applications for at least the benefits described herein. As used herein, the term "about" means plus or minus 10% of a given value unless specifically indicated otherwise.

Figure 1:
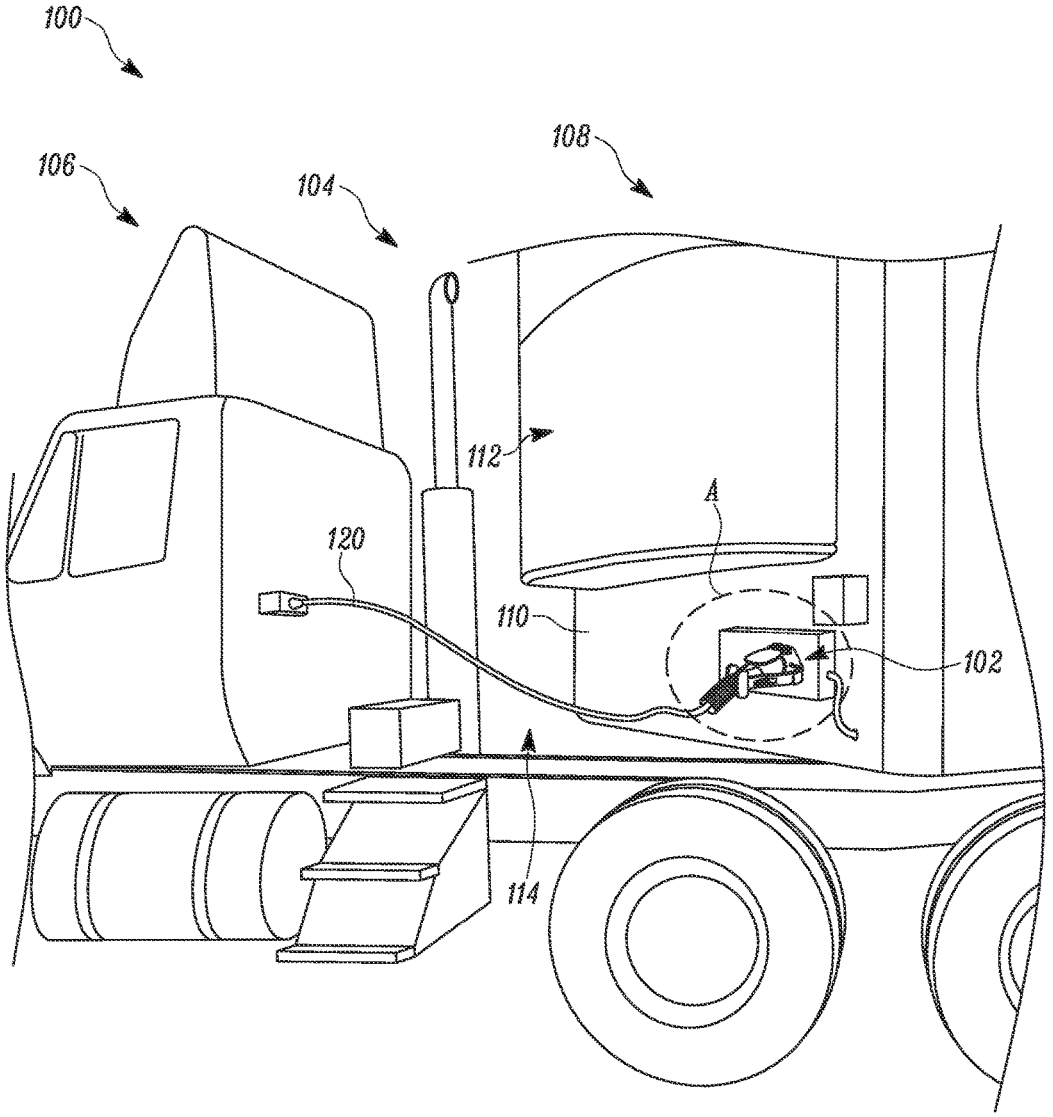
FIG. 1 shows a perspective view of a vehicle with a device for a coupling at a rear portion of the vehicle, according to an embodiment of the present disclosure.

FIG. 1 illustrates a perspective view of a vehicle 100 with a coupling 102 on a rear portion 104 of the vehicle 100, according to an embodiment of the present disclosure. The vehicle 100 in the illustrated FIG. 1 may be, for example, a semi-trailer truck having a tractor unit 106 and a trailer unit 108. In an example, the rear portion 104 of the vehicle 100 having the coupling 102 may be an outer surface 110 on a front portion 112 of the trailer unit 108. Generally, the trailer unit 108 is coupled to a rear end 114 of the tractor unit 106. The coupling 102 includes a socket member 116 (shown in FIG. 2) and a plug member 118 (shown in FIG. 2).

An electrical cable 120 may be provided from a control system (not shown) to connect with the plug member 118 and thereafter the plug member 118 to the socket member 116. The electrical cable 120 can provide electrical power supply and electrical communication to the trailer unit 108. The plug member 118 and the socket member 116 are coupled to each other forming the coupling 102 through a device 122 (shown in FIG. 2) coupled between the plug member 118 and the socket member 116.

Figure 2:
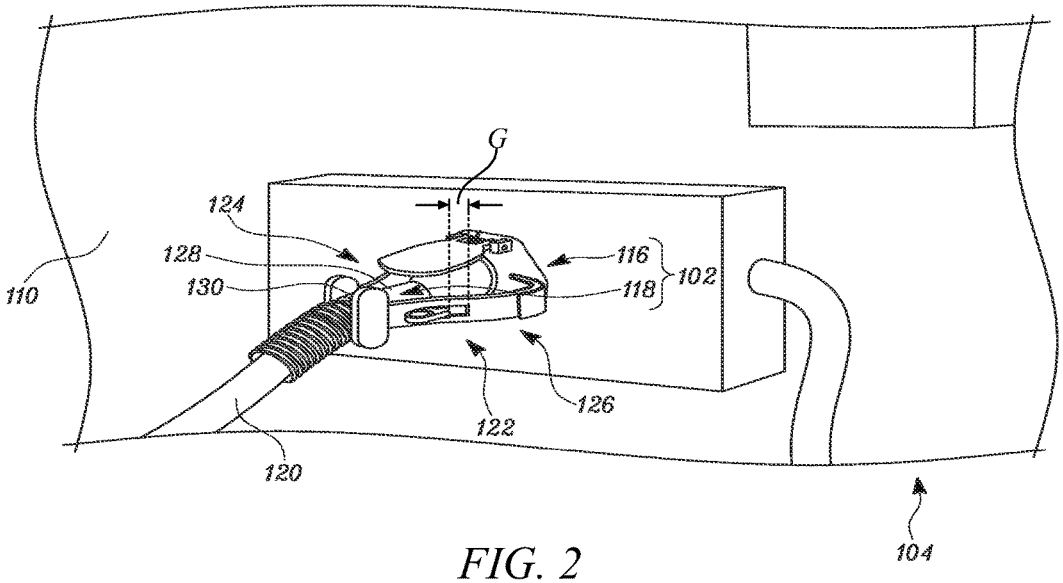
FIG. 2 shows an enlarged view of a portion "A" in the FIG. 1, further illustrating gap G of a static assembled device for a coupling, according to an embodiment of the present disclosure.

FIG. 2 illustrates an enlarged view of a portion "A" shown in FIG. 1. The enlarged portion "A" illustrates the coupling 102 having the plug member 118 connected with the socket member 116 through the device 122. The device 122 provided for mechanically coupling the plug member 118 with the socket member 116 includes an elastic member. In the illustrated embodiment, the coupling 102 is provided with two elastic members. However, it is to be understood that the number of elastic members in the device 122 is not limiting the scope of the present disclosure. The device 122 can have any workable numbers of the elastic members. The illustrated FIG. 2 depicting the two elastic members is configured to provide a stable connection between the plug member 118 and the socket member 116. In the illustrated embodiment, the device 122 includes a first elastic member 124 and the second elastic member 126. The plug member 118 is operably connected with the socket member 116 at a first end 128 and to the electrical cable 120 at a second end 130. The socket member 116 is fixedly connected to the outer surface 110 of the trailer unit 108. The first elastic member 124 and the second elastic member 126 are detachably connected to the socket member 116 using fasteners, including but not limited to, bolts and rivets. In the illustrated embodiment, gap G is shown in slots 154 and/or 156 of device 122, representing the static position of elastic members 124 and/or 126 upon assembly of device 122. Depending upon the material and or configuration of elastic members 124 and/or 126. Gap G may be of zero length/dimension, whereby the edge of slots 154 and/or 156 of device 122 may come to rest on wings 166 and/or 168, according to an embodiment of the present disclosure.

Figure 2S:
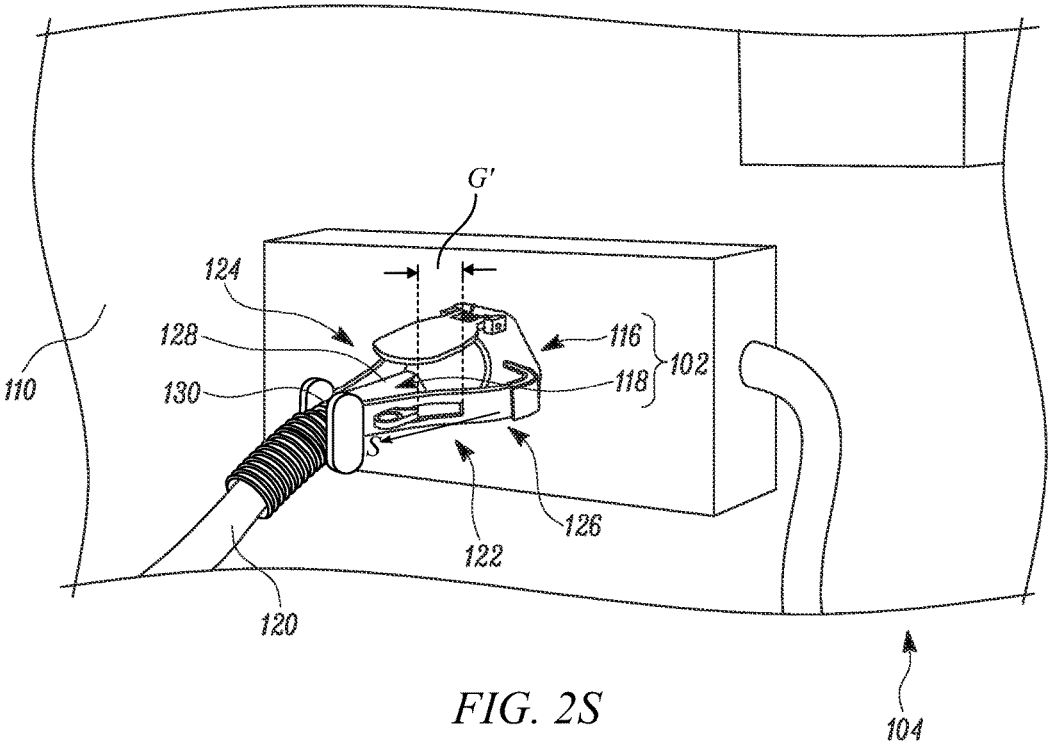
FIG. 2S shows an enlarged view of a portion "A" in the FIG. 1, further illustrating gap G' of a stretched device for a coupling, according to an embodiment of the present disclosure.

FIG. 2S shows an enlarged view of a portion "A" in the FIG. 1, further illustrating gap G' of a stretchable device for a coupling subjected to dynamic forces, i.e., subjected to disturbances or vibrations of the tractor and trailer units 106 and 108, respectively. In the exemplary embodiment, elastic members 124 and/or 126 are stretched generally perpendicularly along line S to a length/dimension of gap G' (greater than gap G in the static position) when elastic members 124 and/or 126 are subjected to dynamic forces.

Figure 3:
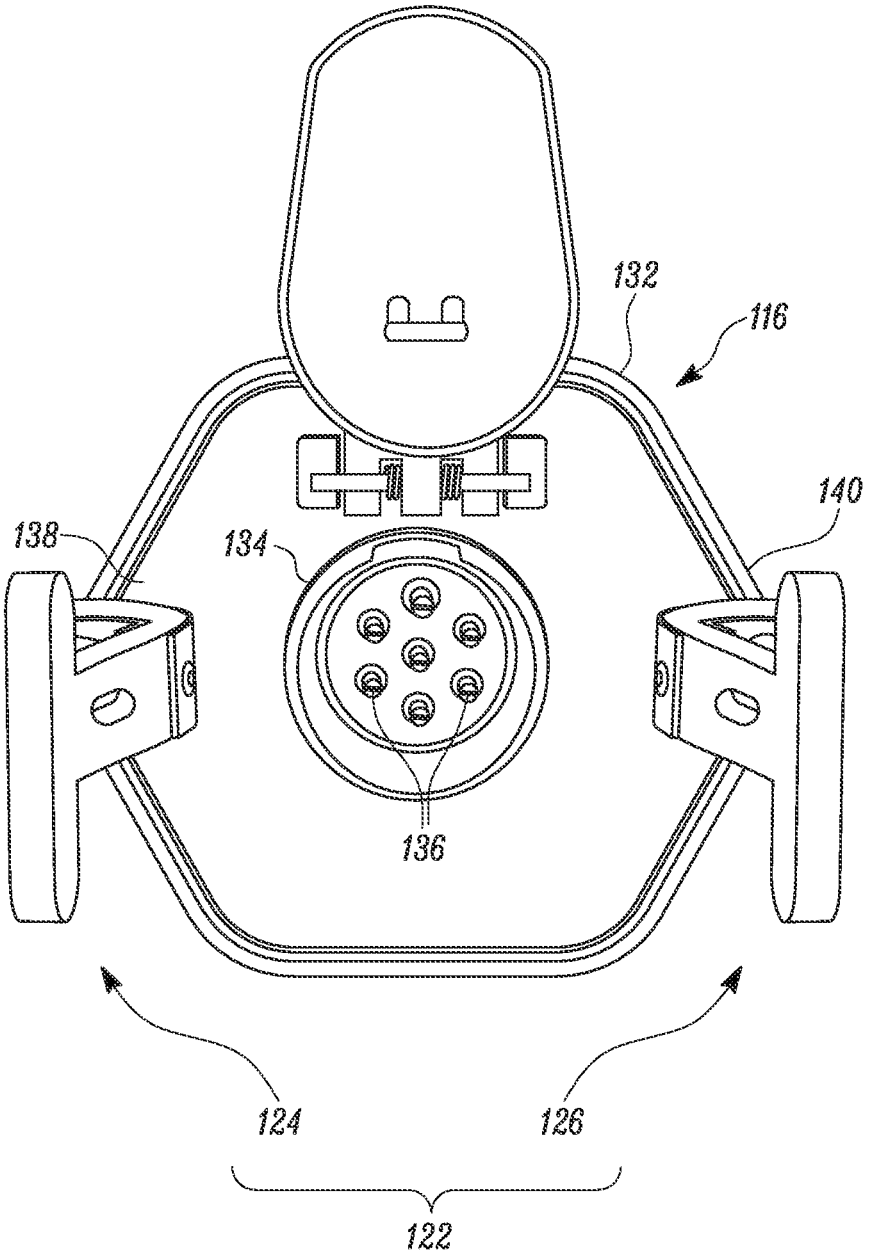
FIG. 3 shows a front perspective view of a socket member of the coupling and a device detachably attached to the socket member of the coupling, according to an embodiment of the present disclosure.

FIG. 3 illustrates a front perspective view of the socket member 116 of the coupling 102 and the device 122 detachably attached to the socket member 116 of the coupling 102 shown in FIG. 2, according to an embodiment of the present disclosure. The socket member 116 includes a flange 132 and an annular sleeve 134. The flange 132 may be adapted to attach with the rear portion 104 of the vehicle 100 (shown in FIG. 2). The annular sleeve 134 may be positioned centrally in the flange 132. The annular sleeve 134 may include one or more male terminal pins 136 to engage with corresponding female terminals (not shown) of the plug member 118 of the coupling 102 for establishing the electrical connection between the plug member 118 and the socket member 116.

The device 122 in the illustrated embodiment includes the first elastic member 124 and the second elastic member 126 at a first end 138 and a second end 140 of the flange 132. The first elastic member 124 and the second elastic member 126 are detachably attached to the flange 132 of the socket member 116 using fasteners. The first elastic member 124 and the second elastic member 126 are adapted to protrude out perpendicularly from a surface of the flange 132 and are configured to receive the plug member 118 for mechanical coupling.

Figure 4:
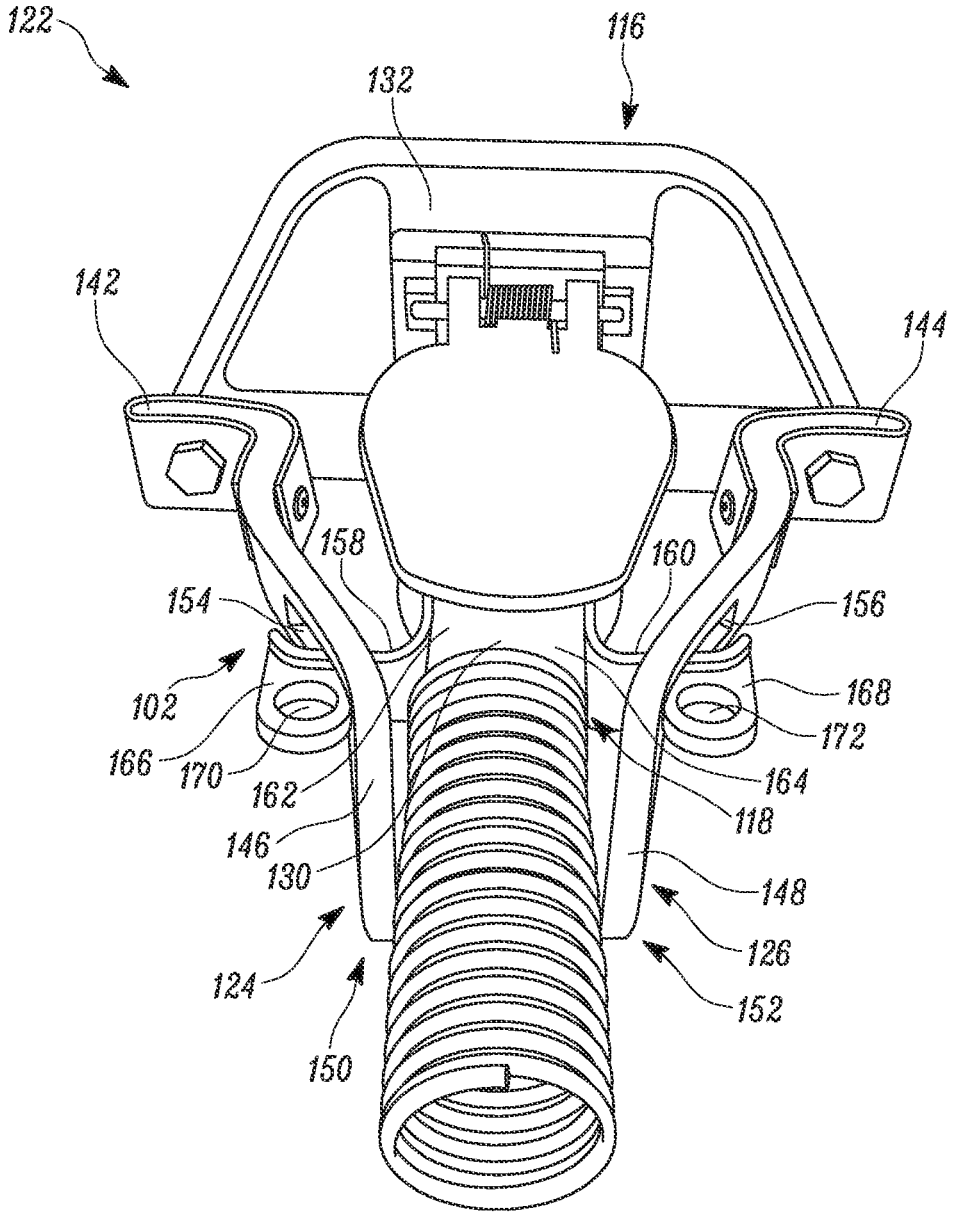
FIG. 4 shows a front perspective view of the device operably engaged with the coupling, according to an embodiment of the present disclosure.

FIG. 4 illustrates a front perspective view of the device 122 shown in FIG. 3 operably engaged with the plug member 118 of the coupling 102, according to an embodiment of the present disclosure. The first elastic member 124 and the second elastic member 126 include first ends 142, 144 which are detachably attached to the flange 132 of the socket member 116. In an embodiment, the first ends 142, 144 of the first elastic member 124 and the second elastic member 126 are fixedly attached to the flange 132 of the socket member 116. Further, the first elastic member 124 and the second elastic member 126 are configured to connect with the plug member 118 of the coupling 102 at second ends 146, 148. The second ends 146, 148 of the first elastic member 124 and the second elastic member 126 are provided with handles 150, 152. The first elastic member 124 and the second elastic member 126 are further provided with slots 154, 156 proximal to the second ends 146, 148 and the handles 150, 152 of the first elastic member 124 and the second elastic member 126, respectively. The plug member 118 of the coupling 102 further includes saddles 158, 160 at opposing sides 162, 164 of the second end 130 of the plug member 118. The saddles 158, 160 are further configured to extend outwardly providing wings 166, 168. The wings 166, 168 are further configured with through holes 170, 172. During assembling of the first elastic member 124 and the second elastic member 126 with the plug member 118, the handles 150, 152 of the first elastic member 124 and the second elastic member 126 are pulled forward such that the slots 154, 156 accommodate the wings 166, 168 of the plug member 118. Thus, the first elastic member 124 and the second elastic member 126 establish a mechanical connection between the socket member 116 and the plug member 118. Furthermore, one or more elastic members 124, 126 maintain a mechanical connection between the socket member 116 and the plug member 118 during disturbances and vibrations of the tractor unit 106 and trailer unit 108 transmitted via, but not limited to, the coupling 102, the socket member 116, and the plug member 118 as discussed below.

Figure 5:
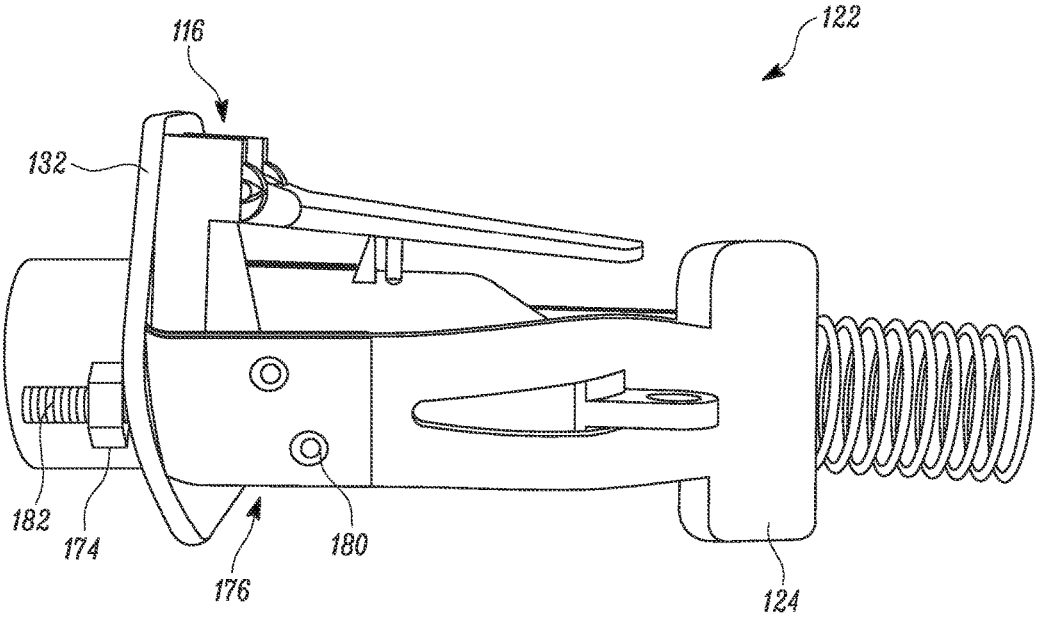
FIG. 5 shows a side perspective view of the device, according to another embodiment of the present disclosure.

FIG. 5 illustrates a side perspective view of the device 122, according to another embodiment of the present disclosure. In the illustrated view, the first elastic member 124 is visible and hence the explanation is restricted to the first elastic member 124 only. However, it is to be understood that the explanation for the second elastic member 126 can be similar to that of the first elastic member 124 and is not meant to be limiting the scope of the present disclosure. The first elastic member 124 of the device 122 is detachably connected to the socket member 116 using the fastener, such as but not limited to, a bolt 182 and a nut 174. In an exemplary embodiment, the first elastic member 124 can be coupled to the socket member 116 through a connecting member 176.

Figure 6:
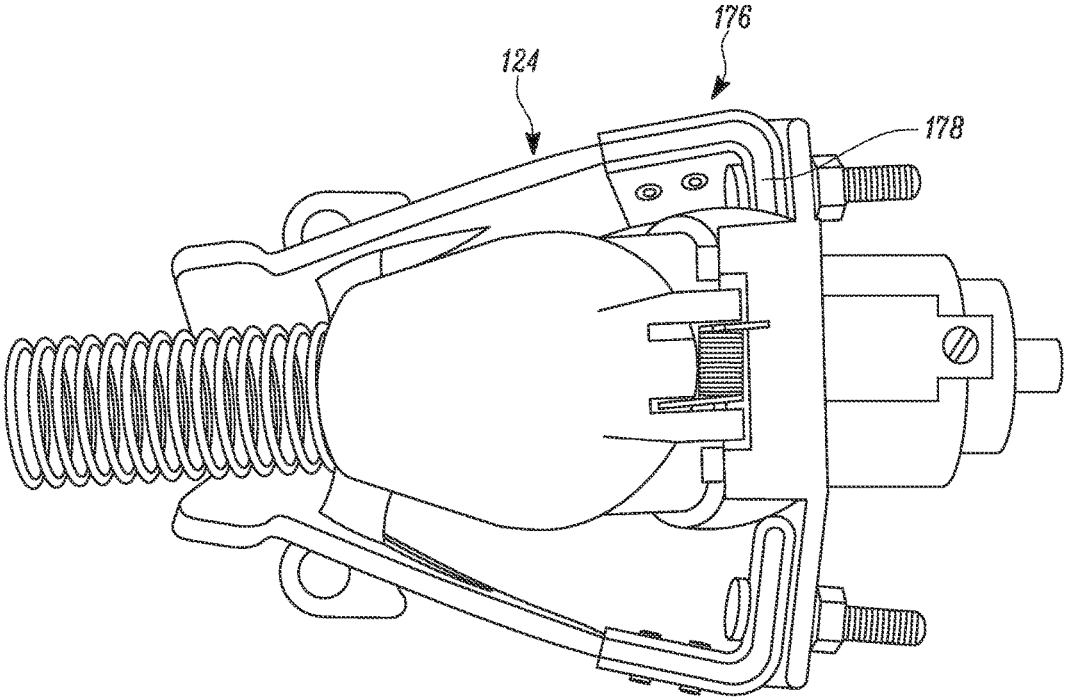
FIG. 6 shows a top perspective view of the device shown in FIG. 5, according to an embodiment of the present disclosure.

In an embodiment, the connecting member 176 may include a rigid sheet of a metallic material wrapped around the first elastic member 124 forming an "L" shaped bracket (shown in FIG. 6) enclosing a first end 178 of the first elastic member 124. Thus, the connecting member 176 is configured to hold the first elastic member 124. In an embodiment, the connecting member 176 can be connected to the first end 178 (shown in FIG. 6) of the first elastic member 124 using a rivet 180. The connecting member 176 enclosing the first end 178 of the first elastic member 124 can be fixed to the flange 132 of the socket member 116 using a fastener, including, but not limited to, a rivet, an adhesive, or stitching. In the illustrated embodiment, the connecting member 176 is fixed using the bolt 182 and the nut 174. In an example, the connecting member 176 can be made of a material including, but not limited to, an aluminum sheet metal with a thickness of about 0.313 inches.

Figure 7:
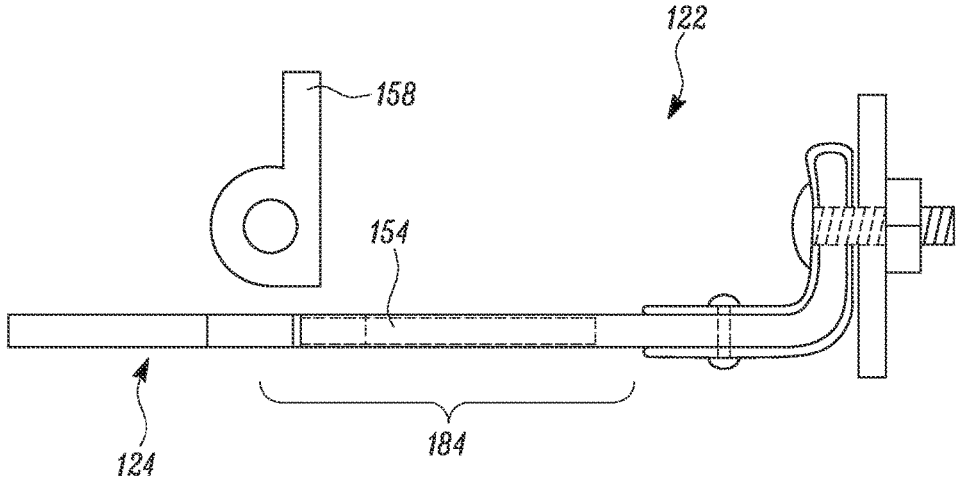
FIG. 7 shows a top view of the device shown in FIGS. 1, 2, 5, and 6, according to an embodiment of the present disclosure.

FIG. 7 illustrates a top view of the first elastic member 124 of the device 122, according to an embodiment of the present disclosure. The term "first elastic member" is used interchangeably with the term "elastic member". The elastic member 124 is configured with the slot 154. In an example, the slot 154 may be provided at a middle portion 184 of the elastic member 124.

The elastic member 124 can be made of materials including, but not limited to, an elastomeric material, a metal, an alloy, a natural or synthetic polymer, or a composite material, such that the material protects an outer surface of a vehicle from widely varying weather conditions. In an example, the elastic member 124 is made of an elastomeric material such as tire rubber. In another example, the elastomeric material may be a Garlock 7199 rubber sheet having a tensile strength of about 1000 psi, an elongation of about 300%, a durometer in a range of about 55 Shore A to 65 Shore A, a width of about 0.75 inches, and a length of about 3.5 inches.

Figure 8:
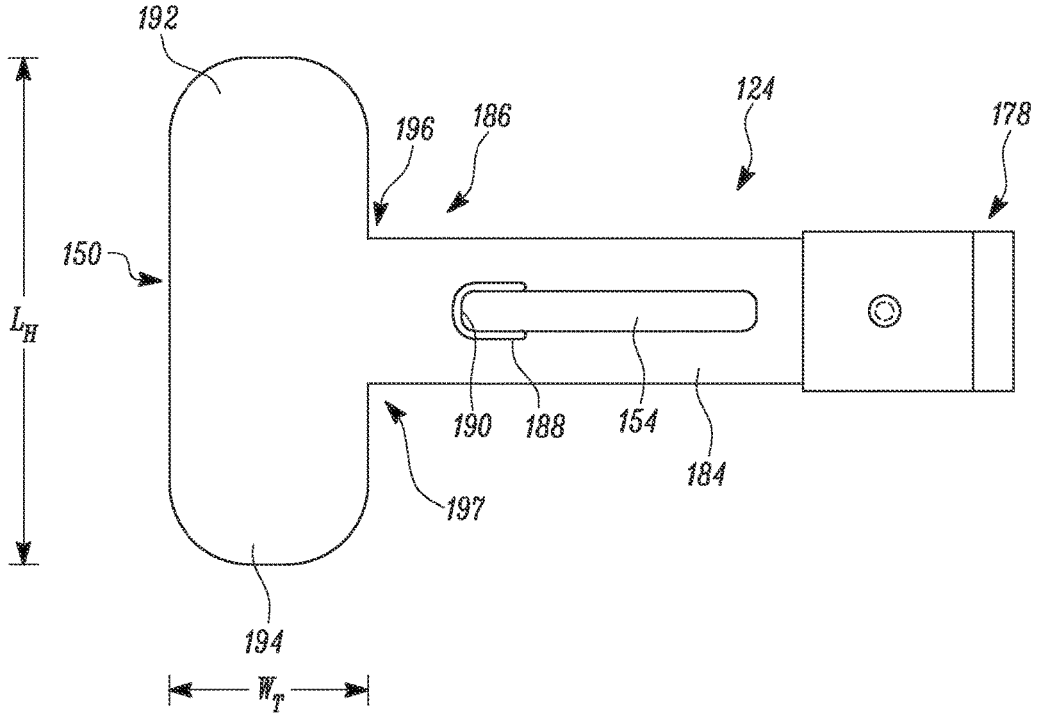
FIG. 8 shows a side view of the device shown in FIG. 7, according to an embodiment of the present disclosure.

FIG. 8 illustrates a side view of the elastic member 124 shown in FIG. 7, according to an embodiment of the present disclosure. The elastic member 124 includes the slot 154 that has an elongated groove form. It is to be understood that the slot 154, in another embodiment, may be of any suitable geometrical or non-geometrical shape capable of engaging with the saddle 158 (shown in FIGS. 4 and 7) of the plug member 118 (as shown in FIG. 4). In an example, the slot 154 may be positioned proximal to the first end 178 or a second end 186 of the elastic member 124. In another example, the slot 154 may be positioned at the middle portion 184 of the elastic member 124.

In an exemplary embodiment, the slot 154 of the elastic member 124 is further provided with a grommet 188. The grommet 188 is fixedly attached to a first end 190 of the slot 154. The grommet 188 is adapted to prevent the slot 154 from yielding. In an embodiment, the grommet 188 can be made of material having yield strength greater than the elastic member 124. In an example, the grommet 188 is semi-circular in shape adapted to cover the first end 190 of the slot 154. For example, when the elastic member 124 is stretched or compressed during the movement of the vehicle 100, the yielding of the slot 154 is prevented due to the presence of the grommet 188 at the first end 190 of the slot 154.

The elastic member 124 includes the handle 150 having a pair of tabs 192, 194 extending perpendicular to the second end 186 of the elastic member 124. The tab 192 and the tab 194 of the handle 150 are positioned on opposing sides 196, 197 of the second end 186 of the elastic member 124 to form the handle 150. The handle 150 is used for holding and maneuvering the elastic member 124 during assembling. In an example, a width "$W_T$" of the tabs 192, 194 can be about 0.5 inches that may be wide enough for a user to hold the tabs 192, 194 during assembling. In an example, a length "$L_H$" of the handle 150 can be about 0.75 inches. In some embodiments, any handle design with varied dimensions may be used such that a person can grab and pull the elastic member 124 with a force, for example, about 10 lbf.

Figure 9:
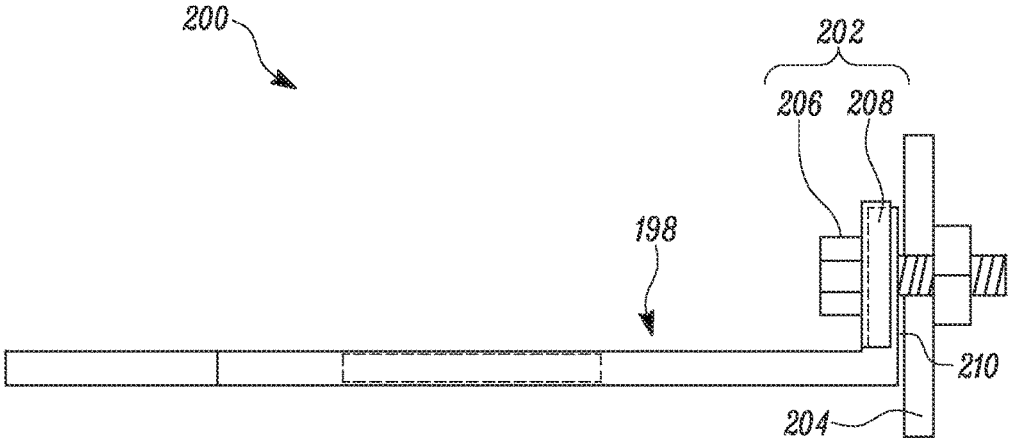
FIG. 9 shows a top view of a device, according to another embodiment of the present disclosure.
Figure 10:
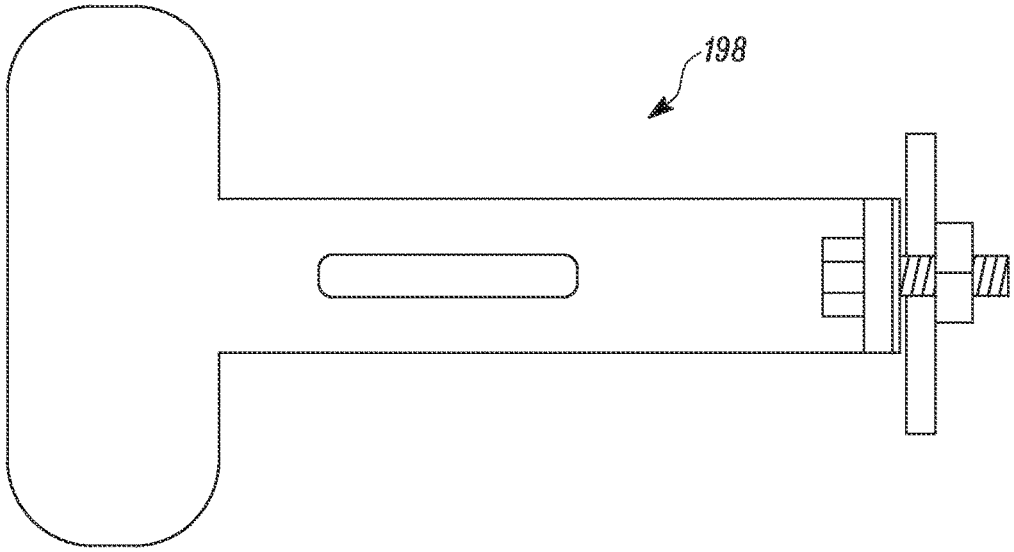
FIG. 10 shows a side view of the device shown in FIG. 9, according to an embodiment of the present disclosure.

FIG. 9 illustrates a top view of an elastic member 198 of a device 200, according to another embodiment of the present disclosure. The elastic member 198 is provided with a connecting member 202 for connecting with a socket member 204. The connecting member 202 includes a bolt 206 and a bracket member 208. In an example, the bracket member 208 is a hollow square shaped bracket. In another example, the bracket member 208 may have a rectangular shape. The shape of the bracket member 208 is determined based on a shape of a first end 210 of the elastic member 198 such that the bracket member 208 may enclose the first end 210 of the elastic member 198. The bracket member 208 is positioned at a right angle to the first end 210 of the elastic member 198. The bracket member 208 is fixedly attached to the first end 210 of the elastic member 198 using the bolt 206. In an example, the same bolt 206 can be used to detachably attach the device 200 to the socket member 204. FIG. 10 is a side view of the elastic member 198 shown in FIG. 9, according to an embodiment of the present disclosure.

In an embodiment, the device 122, 200 explained in the detailed descriptions of FIGS. 1-10, can be operably engaged with the coupling 102 on the vehicle 100. The device 122, 200 is adapted to operably engage with the coupling 102 and restrain the coupling 102 from disengaging and thus acts as a plug member saver. Thus, the device 122, 200 can reduce the maintenance cost associated with the plug member 118.

In an embodiment, the elastic member 124, 126, 198 is designed to have dimensions such that the elastic member 124, 126, 198 is capable of withstanding the forces caused during the movement of the vehicle 100 and thus maintaining the coupling or connection between the plug member 118 and the socket member 116, 204. In an example, an elastic coefficient of the elastic member 124, 126, 198 can be about 5 lbf that can be applied on the wing 166, 168 of the plug member 118. Thus, a suitable elastic coefficient of about 20 lbf per square inch or greater is provided.

In an example, the wing 166, 168 height is about 3.5 inches. A user may apply a pulling force of about 10 lbf to the handle 150, 152 of the elastic member 124, 126, 198 for assembling.

In another example, the range of the force that may be applied to the handle 150, 152 can be about 10 lbf to 25 lbf depending upon the design dimensions of the handle 150, 152.

In an embodiment, the elastic member 124, 126, 198 can be a spring.

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this invention.

LIST OF ELEMENTS

100 Vehicle
102 Coupling
104 Rear portion
106 Tractor unit
108 Trailer unit
110 Outer surface
112 Front portion
114 Rear end
116 Socket member
118 Plug member
120 Electrical cable
122 Device
124 First elastic member
126 Second elastic member
128 First end
130 Second end
132 Flange
134 Annular sleeve
136 Male terminal pins
138 First end
140 Second end
142 First end
144 First end
146 Second end
148 Second end
150 Handle
152 Handle
154 Slot
156 Slot
158 Saddle
160 Saddle
162 Opposing side
164 Opposing side
166 Wing
168 Wing
170 Through hole
172 Through hole
174 Nut
176 Connecting member
178 First end
180 Rivet
182 Bolt
184 Middle portion
186 Second end
188 Grommet
190 First end
192 Tab
194 Tab
196 Opposing side
197 Opposing side
198 Elastic member
200 Device
202 Connecting member
204 Socket member
206 Bolt
208 Bracket member
210 First end
$W_T$ Width
$L_H$ Length

What is claimed is:

1. A stretchable coupling device for providing a coupling of a vehicle to trailer electrical cable connection during relative movement between the vehicle and trailer, the coupling comprising a plug member and a socket member, the plug member adapted to couple with the socket member, the device comprising:

at least one elastic member comprising a slot, the at least one elastic member detachably connected to the socket member at a first end and operably engaged to the plug member at a second end through the slot.

2. The stretchable coupling device of claim 1, further comprising a grommet fixedly attached to a first end of the slot thereof, the grommet adapted to protect the slot from yielding.

3. The stretchable coupling device of claim 1, wherein the at least one elastic member comprises a handle comprising a pair of tabs extending perpendicular to the second end of the at least one elastic member, the pair of tabs adapted to maneuver the at least one elastic member during assembly.

4. The stretchable coupling device of claim 1, further comprising a connecting member adapted to connect the at least one elastic member with the socket member.

5. The stretchable coupling device of claim 4, wherein the connecting member comprises one or more bolts and a bracket member.

6. A stretchable coupling device for providing a coupling of a vehicle to trailer electrical cable connection during relative movement between the vehicle and trailer, the coupling comprising a plug member and a socket member, the plug member adapted to couple with the socket member, the device comprising:

at least one elastic member comprising a slot, the at least one elastic member detachably connected to the socket member at a first end and operably engaged to the plug member at a second end through the slot;

a handle comprising a pair of tabs extending perpendicular to the second end of the at least one elastic member, the pair of tabs adapted to maneuver the at least one elastic member during assembling; and a connecting member adapted to connect the at least one elastic member with the socket member.

7. The stretchable coupling device of claim 6, further comprising a grommet fixedly attached to a first end of the slot thereof, the grommet adapted to protect the slot from yielding.

8. The stretchable coupling device of claim 6, wherein the connecting member comprises one or more bolts and a bracket member.

9. The stretchable coupling device of claim 6, further comprising:

a first connecting member adapted to connect a first elastic member with the socket member; and a second connecting member adapted to connect a second elastic member with the socket member.

10. A stretchable coupling device for providing a coupling of a vehicle to trailer electrical cable connection during relative movement between the vehicle and trailer, the coupling comprising a plug member and a socket member, the plug member adapted to couple with the socket member, the device comprising:

at least one elastic member comprising a slot, the at least one elastic member detachably connected to the socket member at a first end and operably engaged to the plug member at a second end through the slot, wherein the at least one elastic member is operably engaged with the coupling to restrain the coupling from disengaging.

11. The stretchable coupling device of claim 10, further comprising a grommet fixedly attached to a first end of the slot thereof, the grommet adapted to protect the slot from yielding.

12. The stretchable coupling device of claim 10, wherein the connecting member comprises one or more bolts and a bracket member.

13. The stretchable coupling device of claim 10, further comprising:

a first connecting member adapted to connect a first elastic member with the socket member; and a second connecting member adapted to connect a second elastic member with the socket member.

14. The vehicle to trailer connection as in any one of claims 1, 6, and 10, wherein the vehicle is a semi-tractor trailer.

* * * * *